US005975377A

United States Patent [19]

McGowens

[11] Patent Number: 5,975,377

[45] Date of Patent: Nov. 2, 1999

[54] SPRAY DEFLECTOR CAP CONSTRUCTION

[76] Inventor: Helen Marie McGowens, 88 Starboard Ct., Perryville, Md. 21903

[21] Appl. No.: 09/061,551

[22] Filed: Apr. 16, 1998

[51] Int. Cl.[6] ..... B65D 83/00

[52] U.S. Cl. ..... 222/402.13

[58] Field of Search ..... 222/402.13

[56] References Cited

U.S. PATENT DOCUMENTS

| | | | |
|---|---|---|---|
| D. 319,191 | 8/1991 | Pangia | D9/448 |
| 3,550,857 | 12/1970 | Ahlberg | 239/288 |
| 3,958,726 | 5/1976 | Trotta | 222/402.13 |
| 4,053,090 | 10/1977 | Kelly et al. | 222/402.13 |
| 4,685,621 | 8/1987 | Scherer et al. | 239/288 |

*Primary Examiner*—Gregory L Huson
*Attorney, Agent, or Firm*—Henderson & Sturm

[57] ABSTRACT

A spray deflector cap construction 10 including a cylindrical cap member having an enlarged front opening 22 formed on the front face and an enlarged rear opening 23 formed on the rear face, and a finger shaped hollow depressor member 30 hingedly disposed relative to the enlarged rear opening 23 and dimensioned to receive the end of one of the user's fingers 200, wherein the depressor member 30 is engageable with the spray nozzle valve 101 of a spray can 100 to prevent sprayed material from being deposited on the user's finger 200 and/or fingernail 201.

6 Claims, 1 Drawing Sheet

SPRAY DEFLECTOR CAP CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of cap constructions for pressurized spray cans and in particular to a spray deflecting cap construction that prevents the spray from contacting the user's fingertips.

2. Description of Related Art

As can be seen by reference to the following U.S. Pat. Nos. 3,550,857; 4,685,621; and DES 319,191, the prior art is replete with myriad and diverse spray directing and/or deflecting devices.

While all of the aforementioned prior art constructions are more than adequate for the basic purpose and function for which they have been specifically designed, they are uniformly deficient with respect to their failure to provide a simple, efficient, and practical cap construction that will prevent spray blow-back from being deposited on the fingernail and/or the end of one of the user's fingers used to depress the spray nozzle valve of a conventional spray can.

As most women in particular are too well aware, the convenience of pressurized spray can dispensers are very often offset by the negative effects that can be caused to their manicured nails from the spray blow-back that is a common by-product.

As a consequence of the foregoing situation, there has existed a longstanding need for a new and improved type of spray deflector cap construction that is specifically designed to protect the user's fingertips from the deleterious effects of spray blow-back from the nozzles of the spray cans, and the provision of such a construction is a stated objective of the present invention.

BRIEF SUMMARY OF THE INVENTION

Briefly stated, the spray deflector cap construction that forms the basis of the present invention comprises in general a cap unit and an internal depressor unit flexibly connected to the cap unit.

As will be explained in greater detail further on in the specification, the cap unit comprises a generally cylindrical removable cap member which frictionally engages the upper lip of a conventional spray can and is provided with an enlarged front opening that is alignable with the outlet of the spray nozzle valve and further includes an enlarged rear opening dimensioned to receive a user's fingertips.

In addition, the internal depressor unit comprises a finger shaped hollow flexible depressor member dimensioned to be received in the enlarged rear opening in the cap member and dimensioned to overlie the top of the conventional spray nozzle valve.

Furthermore, the design of the cap construction is specifically intended to protect the user's fingertips from being contacted by any spray blow-back from the nozzle spray valve, as would be the case with conventional spray cans not equipped with the cap construction of the present invention.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
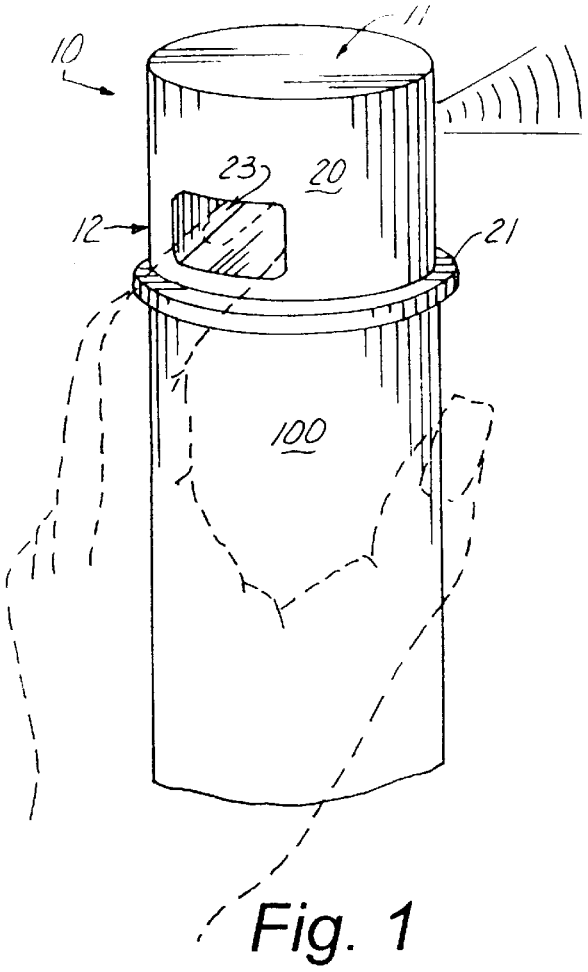
FIG. 1 is a rear perspective view of the deflector cap mounted on a pressurized spray can.

As can be seen by reference to the drawings, and in particularly to FIG. 1, the spray deflector cap construction that forms the basis of the present invention is designated generally by the reference number 10. The construction 10 comprises in general a cap unit 11, and an internal nozzle depressor unit 12. These units will now be described in seriatim fashion.

Figure 2:
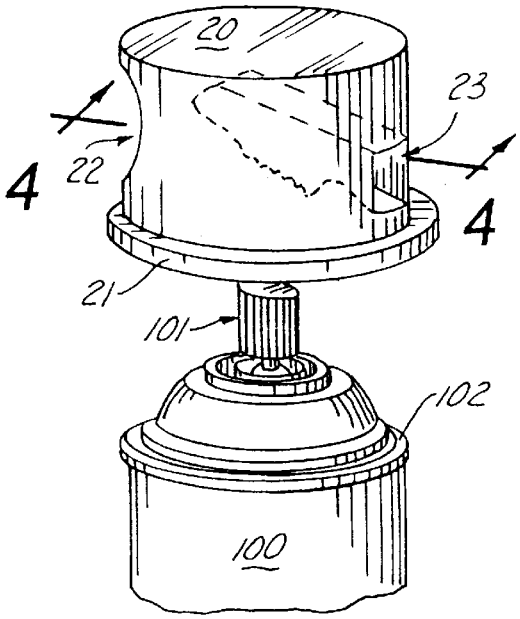
FIG. 2 is an exploded perspective view of the deflector cap and spray can.
Figure 3:
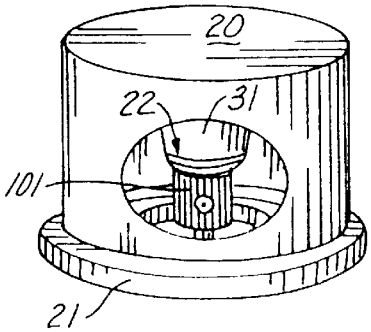
FIG. 3 is an isolated front perspective view of the deflector cap and spray nozzle.

As shown in FIGS. 1 through 3, the cap unit 11 comprises a generally cylindrical cap member 20 having an outwardly extending lower skirt portion 21 on the bottom of the cap member 20 that is dimensioned to frictionally engage the outwardly projecting upper rim 102 on a conventional spray container 100 which is provided with a standard spray nozzle valve 101.

Figure 4:
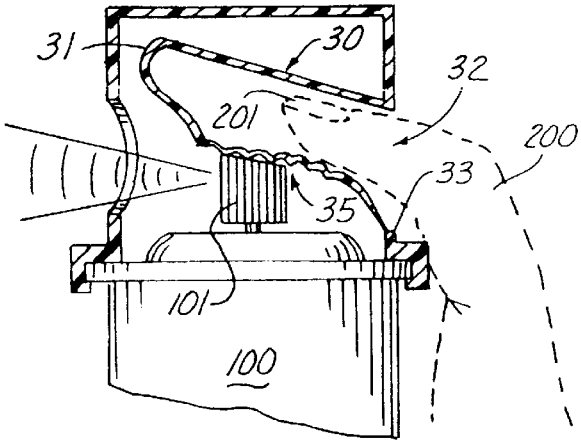
FIG. 4 is a partial cross sectional view of the deflector cap and the spray can.

In addition, the front face of the cap member 20 is provided with an enlarged front opening 22 and the rear face of the cap member 20 is provided with an enlarged rear opening 23 that is dimensioned to receive a user's finger 200 and elongated fingernail 201 in the case of women, as shown in FIGS. 1 and 4.

As can also be seen by reference to FIGS. 1 through 4, the nozzle depressor unit 12 comprises a finger shaped hollow depressor member 30 dimensioned to be received in the enlarged rear opening 23 in the cap member 20 and to overlie and engage the conventional spray nozzle valve 101, on a pressurized spray container 100 as will be explained presently.

As can best be seen by reference to FIGS. 3 and 4, the enlarged front opening 22 of the cap member 20 is alignable with the outlet of the conventional spray nozzle valve 101. The enlarged rear opening 23 is diametrically opposed from the front opening.

In addition, the finger shaped hollow depressor member 30 has a closed inboard end 31 and an enlarged opening 32 formed on the outboard end and defined by a flexible skirt element 33 which is hingedly and sealingly engaged with the periphery of the enlarged rear opening 23 in the cap member 20 such that the finger shaped hollow depressor member 30 can be brought into contact with the top of the spray nozzle valve 101 to force the pressurized contents of the spray can 100 out of the enlarged front opening 22 in the cap member 20.

Furthermore, as can also be seen by reference to FIG. 4, the hollow depressor member 30 defines a type of flexible finger glove. The lower portion of the depressor member 30 may also be provided with a plurality of ridges 35 to enhance the frictional engagement between the depressor member 30 and the top of the spray nozzle valve 101.

It should also be appreciated at this juncture that any blow-back from the spray nozzle valve 101 will be deposited on the outside of the cap member and/or the exterior of the hollow depressor member 30 and that it will be virtually impossible for any spray from the spray nozzle valve 101 from being deposited on the user's fingers 200 and/or fingernails 201.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A spray deflector cap construction for use with a conventional pressurized spray can having a spray nozzle valve and an upper rim wherein the construction comprises:

a cap unit including a generally cylindrical cap member having a top, a bottom, a front face, and a rear face; wherein the front face has an enlarged front opening and the rear face is provided with an enlarged rear opening dimensioned to receive one of the user's fingers; and a depressor unit comprising a finger shaped hollow depressor member flexibly connected on one end to the enlarged rear opening in the cap member and dimensioned to extend through the cap member and overlie the spray nozzle of said spray can wherein the other end of the hollow depressor member is closed and the depressor member completely surrounds the end of the user's finger which extends through the enlarged rear opening in the cap member.

2. The construction as in claim 1 further comprising means for operatively connecting the cap member to the upper rim of the spray can.

3. The construction as in claim 1 wherein the bottom of the cap member is provided with a skirt portion dimensioned to frictionally engage the upper rim of the spray can.

4. The construction as in claim 3 wherein said one end of the depressor member is provided with a flexible skirt portion which is hingedly connected to the periphery of the enlarged rear opening of the cap member.

5. The construction as in claim 1 wherein the enlarged rear opening in the rear face of the cap member and the enlarged front opening in the front face of the cap member are diametrically opposed from one another.

6. The construction as in claim 1 wherein the bottom portion of the hollow depressor member is provided with a plurality of ridges to enhance the frictional engagement of the depressor member with said spray nozzle valve.

* * * * *